US010100639B2

(12) United States Patent
Kallis et al.

(10) Patent No.: US 10,100,639 B2
(45) Date of Patent: Oct. 16, 2018

(54) METHODS AND SYSTEM FOR INDEPENDENTLY CONTROLLING INJECTOR HEAD DRIVE MOTOR SPEEDS

(71) Applicant: PREMIER COIL SOLUTIONS, INC., Waller, TX (US)

(72) Inventors: Shaun Kallis, Waller, TX (US); Javier Sauceda, Waller, TX (US); Randall Dean Behrens, Sealy, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 435 days.

(21) Appl. No.: 14/857,070

(22) Filed: Sep. 17, 2015

(65) Prior Publication Data

US 2016/0076372 A1 Mar. 17, 2016

Related U.S. Application Data

(60) Provisional application No. 62/051,488, filed on Sep. 17, 2014.

(51) Int. Cl.

| | |
|---|---|
| ***E21B 19/22*** | (2006.01) |
| ***E21B 19/08*** | (2006.01) |
| ***F01B 3/00*** | (2006.01) |
| ***F03C 1/26*** | (2006.01) |

(52) U.S. Cl.

CPC ..... *F01B 3/0055* (2013.01); *E21B 19/22* (2013.01); *F01B 3/007* (2013.01); *F03C 1/26* (2013.01)

(58) Field of Classification Search

CPC ..... E21B 19/22; E21B 19/08; E21B 17/20; E21B 7/02; E21B 7/04; E21B 7/24; E21B 44/00; E21B 44/02; F01B 3/0055; F01B 3/007; F03C 1/26; G01M 13/023; B65G 23/44; F16H 7/1263; F16D 31/02; G05B 15/02

See application file for complete search history.

(56) References Cited

U.S. PATENT DOCUMENTS 3,653,636 A * 4/1972 Burrell ..... E21B 19/09 175/5
4,604,724 A * 8/1986 Shaginian ..... E21B 19/20 166/53

(Continued)

FOREIGN PATENT DOCUMENTS

CN 203214464 U 9/2013

OTHER PUBLICATIONS

PCT Search Report & Written Opinion (PCT/US2015/050644), dated Dec. 17, 2015.

*Primary Examiner* — George S Gray
(74) *Attorney, Agent, or Firm* — Lloyd L. Davis; Hunton Andrews Kurth LLP

(57) ABSTRACT

A system for controlling a coiled tubing injector head includes a hydraulic control line in fluid communication with each drive motor, a valve associated with one or both hydraulic control lines, and a sensor associated with each drive motor. Each sensor is configured to output to a digital computer a signal representative of a motor speed, and at least one valve associated with a hydraulic control line is operable to regulate pressure in the hydraulic control line and thereby increase or decrease the speed of the corresponding motor until both speed sensors report substantially matching motor speeds.

12 Claims, 5 Drawing Sheets

(56) References Cited

U.S. PATENT DOCUMENTS

| | | | | |
|---|---|---|---|---|
| 5,826,654 | A * | 10/1998 | Adnan | E21B 19/22 166/250.01 |
| 5,868,201 | A | 2/1999 | Bussear et al. | |
| 6,059,050 | A | 5/2000 | Gray | |
| 6,457,534 | B1 * | 10/2002 | Rolovic | E21B 19/08 166/381 |
| 2004/0040707 | A1 | 3/2004 | Dusterhoft et al. | |
| 2004/0182574 | A1 * | 9/2004 | Adnan | E21B 44/00 166/250.01 |
| 2012/0073833 | A1 * | 3/2012 | McCulloch | E21B 19/22 166/384 |
| 2012/0085553 | A1 * | 4/2012 | Shampine | E21B 7/023 166/384 |
| 2013/0341009 | A1 * | 12/2013 | Gonzalez Cancino | E21B 19/22 166/250.01 |
| 2016/0186509 | A1 * | 6/2016 | Steffenhagen | E21B 44/02 166/53 |

* cited by examiner

METHODS AND SYSTEM FOR INDEPENDENTLY CONTROLLING INJECTOR HEAD DRIVE MOTOR SPEEDS

CROSS-REFERENCE TO RELATED APPLICATIONS

This application claims priority under 35 U.S.C. § 119(e) to U.S. Provisional Patent Application Ser. No. 62/051,488, filed Sep. 17, 2014, which is incorporated herein by reference in its entirety.

FIELD

Embodiments disclosed herein relate to a coiled tubing unit, more particularly, methods and systems for controlling and substantially equalizing injector head drive motor speeds.

BACKGROUND AND SUMMARY

The main engine of a coiled tubing unit is the injector head. This component contains the mechanism to push and pull the coiled tubing in and out of the hole.

In one aspect, embodiments disclosed herein relate to a system for controlling a coiled tubing injector head, the injector head having a pair of continuous loop drive chains having opposed, elongated parallel runs spaced apart to form a path for engaging tubing passing there through, each drive chain independently driven by a drive motor. The system includes a hydraulic control line in fluid communication with each drive motor, a valve associated with one or both hydraulic control lines, and a sensor associated with each drive motor. Each sensor is configured to output to a digital computer a signal representative of a motor speed, and at least one valve associated with a hydraulic control line is operable to regulate pressure in the hydraulic control line and thereby increase or decrease the speed of the corresponding motor until both speed sensors report substantially matching motor speeds.

In other aspects, embodiments disclosed herein relate to a method for controlling a coiled tubing injector head, the injector head having a pair of continuous loop drive chains having opposed, elongated parallel runs spaced apart to form a path for engaging tubing passing there through, each drive chain independently driven by a motor. The method includes selecting a desired drive motor speed, monitoring sensor outputs associated with each drive motor speed, and operating a valve associated with one or both of the drive motors to increase or decrease hydraulic pressure to a swash plate of one or both of the drive motors until both speed sensors report substantially matching outputs.

BRIEF DESCRIPTION OF THE DRAWINGS

The invention is illustrated in the accompanying drawings wherein.

DETAILED DESCRIPTION

Figure 1:
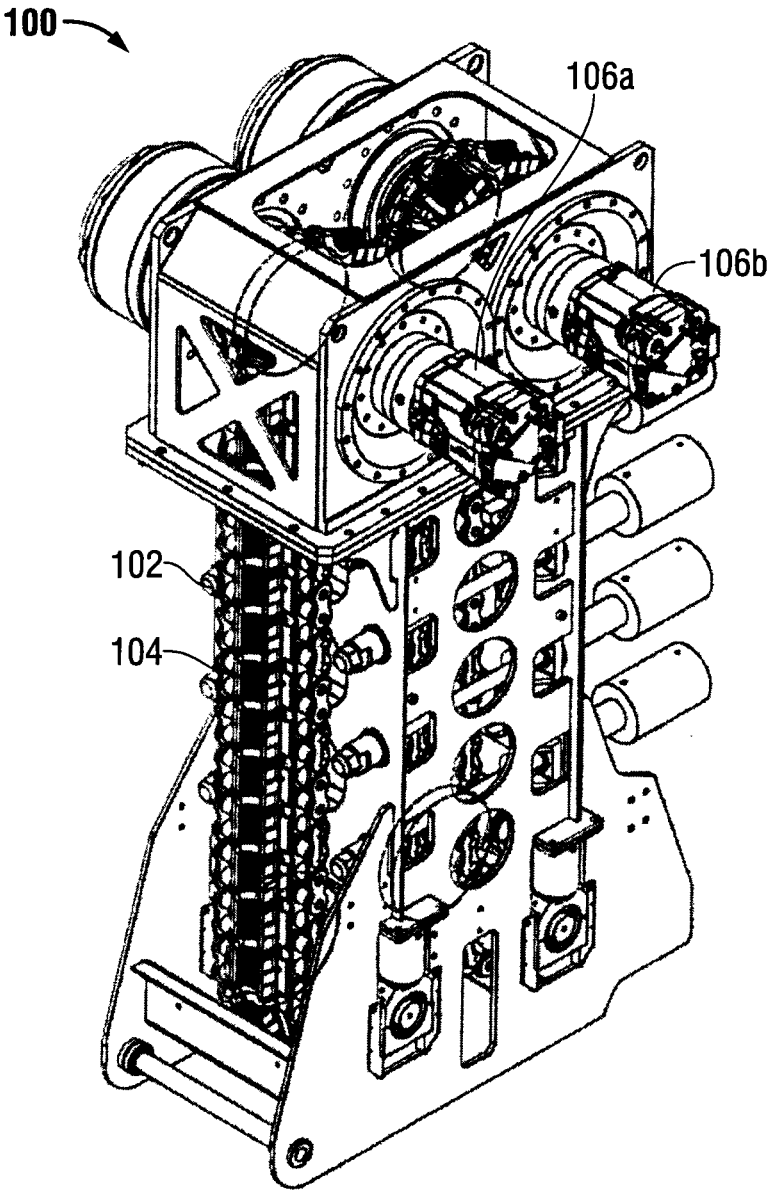
FIG. 1 illustrates an embodiment of an injector head unit.

Methods and systems for controlling injector head drive motor speeds on a coiled tubing injector head drive using motor speed sensors, a programmable logic controller ("PLC" or programmable controller) and one or more control valves to electronically control the speeds of injector head drive motors, are disclosed. FIG. 1 illustrates an injector head 100 including a pair of continuous loop drive chains 102 having opposed, elongated parallel runs spaced apart to form a path for engaging tubing passing there through. The drive chains carry one or more gripper inserts 104. Each drive chain 102 is mounted on an upper drive sprocket (not shown) and a lower drive sprocket (not shown). Each drive chain is driven by an independent hydraulic motor 106*a* and 106*b*. Systems and methods disclosed herein independently control the hydraulic drive motors by decreasing or increasing the speed of one or both of the hydraulic drive motors so their speeds are substantially the same, thereby reducing the potential of the pipe slipping through the gripper inserts 104.

In one embodiment, the injector head drive motors may be hydraulic axial piston pumps, or any type of positive displacement pump that has a number of pistons in a circular array within a cylinder block. The axial piston pumps may be variable displacement units. Axial piston pumps include movable cams, also referred to as a swash plate, yoke or hanger. For conceptual purposes, the swash plate may be represented by a plane, the orientation of which, in combination with shaft rotation, provides swash plate action that leads to piston reciprocation and thus pumping. The angle between a vector normal to the swash plate plane and the cylinder block axis of rotation, called the swash plate angle, is a variable that determines the displacement of the pump or the amount of fluid pumped per shaft revolution. Variable displacement units have the ability to vary the swash plate angle during operation. Axial piston pump components and operation are otherwise generally known and not discussed in greater detail.

Figure 2A:
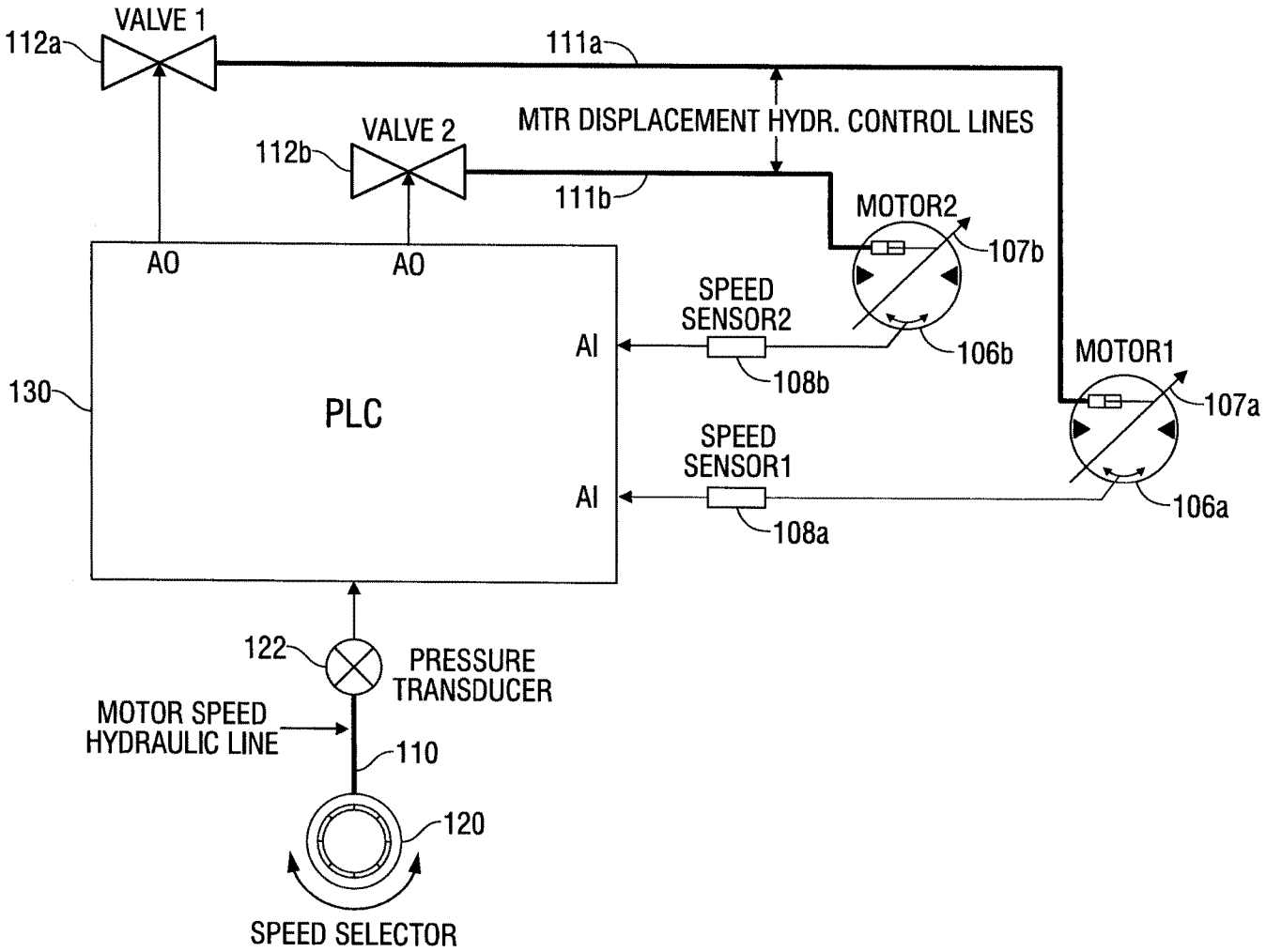
FIG. 2A illustrates an embodiment of a system block diagram for electronically controlling injector head main drive motors.
Figure 3A:
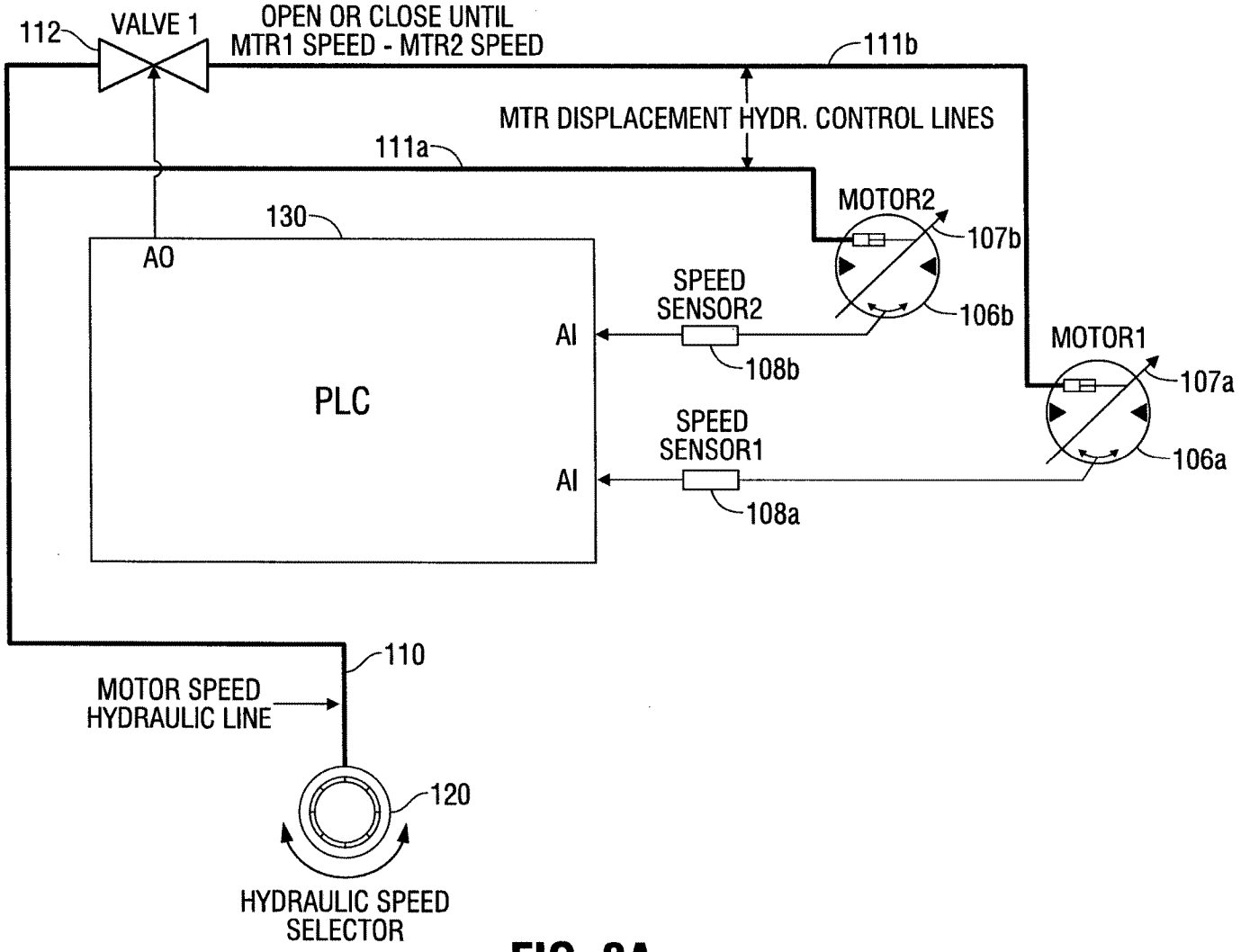
FIG. 3A illustrates an embodiment of a system block diagram for electronically controlling injector head main drive motors.

FIGS. 2A and 3A illustrate system block diagrams for embodiments implementing methods of electronically controlling injector head drive motors 106*a* and 106*b*. Drive motors 106*a* and 106*b* are supplied fluid from a hydraulic source (not shown) through a main hydraulic line 110. A motor speed selector 120 is disposed in the main hydraulic line 110 for setting a desired speed of the hydraulic motors 106*a* and 106*b*. A pressure transducer 122, or pressure transmitter, may be disposed, but is not required, in the hydraulic line 110 (FIG. 2A) and may be configured to convert pressure into an analog electrical signal to be sent to a digital computer, for example, programmable logic controller 130, or "PLC." Any type of pressure transducer may be used providing any type of electrical output, including millivolt, amplified volt, and 4-20 mA. In one embodiment, a 0-400 psi, 4-20 mA pressure transducer is used. In one embodiment, the PLC may be a Siemens 1215C Siplus PLC, however any PLC may be used.

Fluid is also provided at a reduced pressure through motor displacement hydraulic control lines 111*a* and 111*b* to swash plates 107*a* and 107*b* of each motors 106*a* and 106*b*, respectively. The reduced pressure supply through motor displacement control lines 111*a* and 111*b* may be from the same power supply as the main hydraulic line 110. In alternative embodiments, the fluid supplies may be separate. Pressurized hydraulic fluid from, for example, a power pack, is supplied through the motor displacement hydraulic control lines 111*a* and 111*b* to control movement of the swash plates 107*a* and 107*b* of each motor 106*a* and 106*b*. Movement of the swash plates 107*a* and 107*b* is regulated by pressure changes in the motor displacement hydraulic control lines. As shown, the motor displacement hydraulic control lines supply fluid to swash plates 107*a* and 107*b* of each of the drive motors 106*a* and 106*b*, respectively, in parallel.

Valves 112*a* and 112*b* may be disposed in one (FIG. 3A) or both (FIG. 2A) of the motor displacement hydraulic control lines 111*a* and 111*b* for controlling or regulating hydraulic pressure to swash plates 107*a* and 107*b* of each of the hydraulic motors 106*a* and 106*b*. The valves may be any type. In one embodiment, the valves are electro-proportional, direct-acting, pressure reducing and relieving valves. Speed sensors 108*a* and 108*b* are operatively connected with each of the hydraulic motors 106*a* and 106*b*, respectively. In one embodiment, speed sensors may be Linde CEH-10 inductive speed sensors.

Figure 2B:
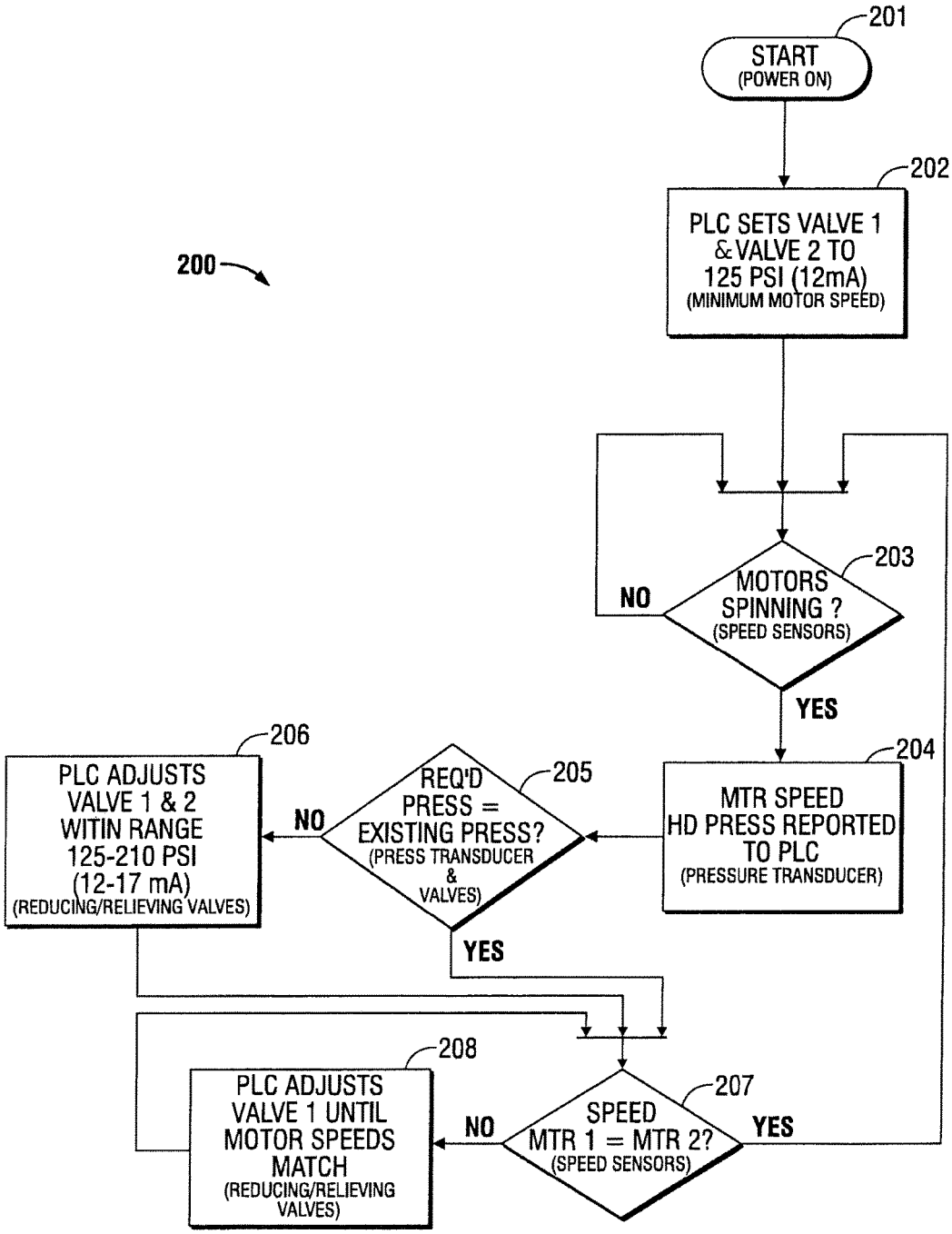
FIG. 2B illustrates an embodiment of a flow diagram for controlling injector head main drive motors shown in FIG. 2A.

FIG. 2B illustrates a flow diagram 200 with representative steps for electronically controlling speeds of the hydraulic drive motors 106*a* and 106*b* according to the system shown in FIG. 2A. Referring to FIGS. 2A and 2B together, at power-up (see Step 201), an operator selects a desired motor speed via the speed selector dial 120. The PLC 130 configures the valves 112*a* and 112*b* to regulate displacement of the swash plates 107*a* and 107*b* in each of the hydraulic motors 106*a* and 106*b* (see Step 202). The PLC 130 may set the valves 112*a* and 112*b* to deliver to the hydraulic motor swash plates any range of hydraulic pressures, for example, at least 75 psi, or at least 100 psi, or at least 125 psi, or at least 200 psi, or greater. In one embodiment, the PLC 130 may transmit the appropriate current to the valves 112*a* and 112*b*, thereby setting the valves to deliver the appropriate pressure to each of the hydraulic motors 106*a* and 106*b*, respectively. Once the hydraulic motors 106*a* and 106*b* are operating, the pressure transducer 122 continues measuring pressure in the hydraulic line 110 (e.g., a "motor displacement hydraulic line") (see Step 204), and the motor hydraulic supply may be adjusted to maintain the hydraulic motors speeds within a certain range of hydraulic pressure according to the speed set by the operator. In one embodiment, hydraulic pressure to each of the hydraulic motors 106*a* and 106*b* may be within a range of approximately 125-210 psi (12-17 mA). If the hydraulic pressure is not within the selected range, the PLC adjusts one or both valves 112*a* and 112*b* to bring hydraulic pressure back within the selected range (see Step 206).

The PLC 130 monitors outputs representative of motor speeds from the sensors 108*a* and 108*b*. In one embodiment, the sensors 108*a* and 108*b* may be inductive speed sensors generating square wave frequency outputs. If the sensor outputs do not match (e.g., speed sensor frequencies do not match), the PLC 130 adjusts one or both of the valves 112*a* and 112*b*, thereby manipulating swash plates 107*a* and 107*b* of the motors, until both speed sensors 108*a* and 108*b* report substantially matching outputs or frequencies.

Figure 3B:
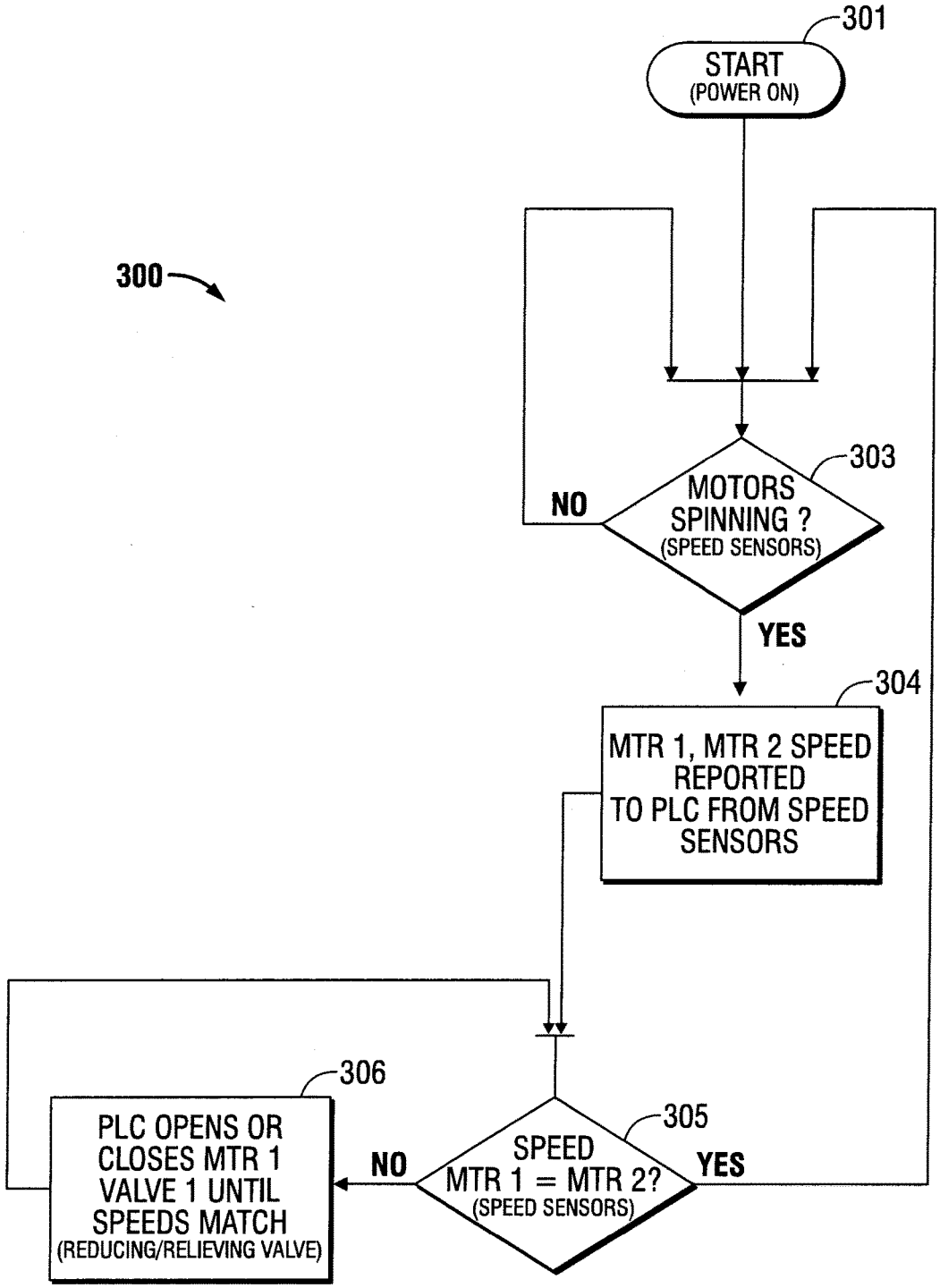
FIG. 3B illustrates an embodiment of a flow diagram for controlling injector head main drive motors shown in FIG. 3A.

In one embodiment, only one valve is adjusted, thereby manipulating one swash plate of a motor. FIG. 3B illustrates a flow diagram 300 with representative steps for electronically controlling speeds of the hydraulic drive motors 106*a* and 106*b* according to the system shown in FIG. 3A. Referring to FIGS. 3A and 3B together, the PLC 130 monitors outputs representative of motor speeds from the sensors 108*a* and 108*b* (see Step 304). If the two speed sensor outputs or frequencies do not match, the PLC 130 gradually adjusts one valve 112*b* to regulate the pressure to the displacement or swash plate of the motor (see Step 306), and increase or decrease the speed of the corresponding motor 112*b* until both speed sensors 108*a* and 108*b* report substantially matching outputs or frequencies. In certain embodiments, the valve is adjusted until sensor outputs representative of motor speed or frequencies match once, or in other embodiments for over a period of time or in multiple instances.

Advantageously, embodiments disclosed herein provide systems and methods for controlling and substantially equalizing the main drive motor speeds independently by decreasing or increasing the speed of one or both drive motors, thereby reducing the potential of the pipe slipping through the gripper inserts, without requiring separate auxiliary or timing motors coupled to the main drive motors, or timing gears.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A system for controlling a coiled tubing injector head, the system comprising:

a coiled tubing injector head, the injector head having a first continuous loop drive chain independently driven by a first hydraulic motor, and a second continuous loop drive chain independently driven by a second hydraulic motor, the first and second drive chains having opposed, elongated parallel runs spaced apart to form a path for engaging tubing passing there through;

a first hydraulic control line in fluid communication with the first hydraulic motor, and a first valve operable to regulate pressure in the first hydraulic line;

a second hydraulic control line in fluid communication with the second hydraulic motor, and a second valve operable to regulate pressure in the second hydraulic line;

a first sensor configured to output to a digital computer a signal representative of the speed of the first hydraulic motor; and a second sensor configured to output to the digital computer a signal representative of the speed of the second hydraulic motor, wherein the speed of either of the first or second hydraulic motor is increased or decreased independently of the other hydraulic motor by manipulating respective first and second valves so that the first and second sensor outputs are substantially the same.

2. The system of claim 1, wherein at least one valve is operable to regulate pressure in at least one hydraulic control line to a swash plate of the corresponding motor.

3. The system of claim 1, wherein the digital computer is a programmable logic controller.

4. The system of claim 1, wherein at least one sensor is configured to a transmit a frequency output corresponding with a motor speed to the digital computer.

5. The system of claim 1, further comprising a pressure transducer disposed in one or both hydraulic control lines, wherein the pressure transducer is configured to convert a pressure reading into an analog electrical signal to be sent to the digital computer.

6. The system of claim 1, further comprising a speed selector configured to set a desired drive motor speed.

7. The system of claim 1, wherein the sensor is an inductive speed sensor configured to generate square wave frequency outputs.

8. The system of claim 1, wherein the valve is electro-proportional, direct-acting, and pressure reducing and relieving.

9. A method for controlling motor speeds of hydraulic motors on a coiled tubing injector head, the injector head having a first continuous loop drive chain independently driven by a first hydraulic motor, and a second continuous loop drive chain independently driven by a second hydraulic motor, the first and second drive chains having opposed, elongated parallel runs spaced apart to form a path for engaging tubing passing there through, the method comprising:

selecting a desired hydraulic motor speed;

monitoring a first sensor output representative of the first hydraulic motor speed monitoring a second sensor output representative of the second hydraulic motor speed; and operating a first valve associated with the first hydraulic motor to increase or decrease the speed of the first hydraulic motor independently of the second hydraulic motor, or operating a second valve associated with the second hydraulic motor to increase or decrease the speed of the second hydraulic motor independently of the first hydraulic motor, until the first and second speed sensors indicate substantially matching outputs.

10. The method of claim 9, further comprising transmitting the sensor outputs to a digital computer.

11. The method of claim 9, further comprising each sensor outputting a square wave frequency output corresponding with the speed of the associated hydraulic motor.

12. In a system for controlling a coiled tubing injector head, the injector head having a first continuous loop drive chain independently driven by a first hydraulic motor, and a second continuous loop drive chain independently driven by a second hydraulic motor, the first and second drive chains having opposed, elongated parallel runs spaced apart to form a path for engaging tubing passing there through, the system comprising:

a first hydraulic control line in fluid communication with the first hydraulic motor, and a first valve operable to regulate pressure in the first hydraulic line;

a second hydraulic control line in fluid communication with the second hydraulic motor, and a second valve operable to regulate pressure in the second hydraulic line;

a first sensor configured to output to a digital computer a signal representative of the speed of the first hydraulic motor; and a second sensor configured to output to the digital computer a signal representative of the speed of the second hydraulic motor, a method comprising the steps of:

monitoring sensor outputs from each sensor associated with each hydraulic motor speed; and operating the first valve to increase or decrease the speed of the first hydraulic motor independently of the second hydraulic motor, or operating the second valve to increase or decrease the speed of the second hydraulic motor independently of the first hydraulic motor, until both speed sensors report substantially matching outputs.

* * * * *